US007815493B2

(12) United States Patent
Pflager et al.

(10) Patent No.: US 7,815,493 B2
(45) Date of Patent: Oct. 19, 2010

(54) APPARATUS AND METHOD FOR POSITIONING A DEVICE NEAR A WORKPIECE DURING MACHINING OPERATIONS

(75) Inventors: William Wood Pflager, Waynesboro, PA (US); Joel Kym Metzler, Greencastle, PA (US); Timothy William Hykes, Greencastle, PA (US)

(73) Assignee: Cinetic Landis Corp., Waynesboro, PA (US)

( * ) Notice: Subject to any disclaimer, the term of this patent is extended or adjusted under 35 U.S.C. 154(b) by 756 days.

(21) Appl. No.: 10/270,087

(22) Filed: Oct. 11, 2002

(65) Prior Publication Data

US 2004/0072521 A1 Apr. 15, 2004

(51) Int. Cl.
*B24B 7/00* (2006.01)
*B24C 3/05* (2006.01)

(52) U.S. Cl. ..... 451/181; 451/420; 451/450

(58) Field of Classification Search ..... 451/415, 451/420, 449, 49, 181, 236, 450, 118; 33/555.1, 33/555.3, 655, 657, 660
See application file for complete search history.

(56) References Cited

U.S. PATENT DOCUMENTS 1,941,456 A * 1/1934 Arnold ..... 33/556
3,928,945 A * 12/1975 Devillers ..... 451/236
4,619,078 A * 10/1986 Uhlig ..... 451/5
5,761,821 A * 6/1998 Laycock ..... 33/555.1
6,088,924 A * 7/2000 Esteve ..... 33/551
6,244,928 B1 * 6/2001 Hiramoto ..... 451/5
6,298,571 B1 * 10/2001 Dall'Aglio et al. ..... 33/555.1
6,454,636 B1 * 9/2002 Iwabuchi ..... 451/450
6,585,564 B1 * 7/2003 Hiramoto et al. ..... 451/450
6,602,120 B2 * 8/2003 Bavelloni ..... 451/236
6,645,047 B1 * 11/2003 Liskow ..... 451/9

* cited by examiner

*Primary Examiner*—Hadi Shakeri
(74) *Attorney, Agent, or Firm*—Reising Ethington P.C.

(57) ABSTRACT

An apparatus mounted to a machine for positioning a device near a workpiece during a machining operation, during which the workpiece is movable relative to a machining tool. The apparatus comprises an arm coupled to the machining tool and movable relative thereto to mimic movement of the workpiece relative to the machining tool. The arm includes a shoe for contacting the workpiece during the machining operation. The apparatus further comprises a linear actuator coupled to the arm for moving the arm between a retracted position and an engaged position. According to one embodiment of the present invention, the apparatus includes a coolant nozzle assembly. According to another embodiment of the invention, the apparatus includes a workpiece support shoe. According to still another embodiment of the present invention, the apparatus includes an in-process gauge assembly.

38 Claims, 11 Drawing Sheets

APPARATUS AND METHOD FOR POSITIONING A DEVICE NEAR A WORKPIECE DURING MACHINING OPERATIONS

BACKGROUND OF THE INVENTION

1. Technical Field of the Invention

The present invention relates to grinding machines and to methods of machining workpieces having at least one eccentric diametral portion, such as crankshafts or the like. More particularly, the present invention relates to grinding machines and to methods of machining workpieces having at least one eccentric diametral portion wherein an apparatus is provided to position a device, such as a coolant nozzle, an in-process gauge, a workpiece support, or the like, near the workpiece during a machining operation.

2. Brief Description of the Related Art

With reference to FIG. 1, a conventional grinding machine 10 for machining generally cylindrical workpieces 20 includes a workpiece carrier 12 having aligned headstock 14 and footstock 16 positioned relative to one another along a carrier axis "C". The headstock 14 and footstock 16 are configured to mount the workpiece 20 therebetween for powered rotation of the workpiece 20 about the carrier axis "C". Workpiece 20 includes a workpiece axis "W" (FIG. 2) which typically is coincident with the carrier axis "C" when the workpiece 20 is mounted between the headstock 14 and the footstock 16.

A typical grinding machine 10 also includes a wheelhead 30 having a spindle 31 fixedly mounted thereto for driving the rotation of a grinding wheel 32 in a first direction $\omega_G$ (FIG. 2) about a grinding wheel axis "G". The wheel axis "G" typically is parallel to the carrier axis "C", and thus, parallel to the workpiece axis "W", although it may be oriented at some angle relative thereto. Workpiece 20 typically is rotated about its workpiece axis "W" in a second direction $\omega_W$ (FIG. 2) opposite the first direction $\omega_G$ at a rate less than the rate at which the grinding wheel 32 is rotated.

Typically, the wheelhead 30 is mounted on one or more slides 34 to permit reciprocating translation of the wheelhead 30 towards and away from the workpiece 20 along a slide direction "S", which may be perpendicular to the carrier axis "C", although it may alternatively be oriented at some angle relative thereto. The arrangement described above and shown in FIG. 1 is ideal for machining workpieces 20 having constant cross-section portions centered on-axis to the workpiece axis "W", such as large shafts (which may include one or more stepped portions, as shown in FIG. 1) or such as the mainbearings 42 of a crankshaft 40 (which is shown in greater detail in FIG. 3). During a machining operation, the wheelhead 30 moves under programmed control along the slide direction "S" at some preselected rate chosen to provide a desired rate of material removal from the workpiece 20.

With additional reference now to FIG. 2, it oftentimes is desirable to position one or more devices near the workpiece 20 during some machining operations. For example, a coolant nozzle 50 (shown partially) may be mounted fixedly to the wheelhead 30 by conventional means (not shown) and positioned thereon to direct a flow of coolant generally in a path along a fluid direction "F". Fluid path "F" directs coolant towards a portion of the workpiece 20 being machined for the purpose of dissipating heat generated during the machining operation and also for the purpose of flushing material removed from the workpiece 20 during machining. Similarly, an in-process gauge (not shown) may be mounted to the wheelhead 30 either alone or together with the coolant nozzle 50 and positioned thereon to engage the portion of the workpiece 20 being machined, for example, for the purpose of measuring the diameter of the workpiece 20 as it is being machined.

Regardless of the type of device mounted to the machine 10, in the case of a workpiece 20 having constant cross-section portions (or having cross-section portions with very little eccentricity), the grinding wheel-workpiece interface "P" (which is represented herein as a point located in two dimensional space) remains substantially unchanged during the entire machining operation. This is because the workpiece 20 (which rotates about its workpiece axis "W") and the grinding wheel 32 (which rotates about its wheel axis "G") do not move substantially relative to one another during a complete machining operation or cycle. Accordingly, the coolant nozzle 50, for example, may be mounted to the wheelhead 30 and positioned in a fixed orientation relative to the wheelhead 30 to direct coolant therefrom towards the contact point "P". Because the location of the contact point "P" does not change substantially during such machining operations, the coolant nozzle 50 will continue to direct coolant along the generally-unchanging path "F" towards the contact point "P" substantially at all times during the machining operation without substantial variation.

However, in the case of a workpiece having cross-sectional portions with large degrees of eccentricity or in the case of a workpiece having portions thereof which orbit about the workpiece axis "W" along an outward path (such as in the case of crankshaft crankpins), the grinding wheel-workpiece contact point exhibits significant variation during an entire machining cycle.

For example, referring now to FIG. 3, a typical crankshaft 40 includes one or more generally cylindrical coaxial mainbearings 42 spaced along a mainbearing axis "MB" and one or more generally cylindrical crankpins 44 located between mainbearings 42 and rigidly connected thereto by one or more crankarms 46. Each crankpin 44 includes a crankpin axis "CP", which is oriented parallel to the mainbearing axis "MB" and is spaced radially therefrom by some preselected distance. All crankpin axes "CP" may be aligned along a single axis, although it is typical for the crankpins 44 to be spaced at intervals equidistantly around the mainbearing axis "MB". Crankarms 46 may include counterweights 48 located opposite crankpins 44 and positioned radially outwardly from the mainbearing axis "CB" so as to minimize the effects of rotational inertia due to motion of the crankpins 44 about the mainbearing axis "MB".

With additional reference now to FIGS. 4 and 5, each crankpin 44 (and thus, each crankpin axis "CP") will follow a circular path "R" about the mainbearing axis "MB" during each rotation of the crankshaft 40 (shown in phantom lines). During a complete machining operation, the crankshaft 42 is rotated one or more times about the mainbearing axis "MB", and the grinding wheel 32 is moved controllably towards and away from the crankpin 44 along direction "S" during each rotation of the crankshaft 40 in unison therewith so as to maintain the point of contact "P" with the crankpin 44 as it orbits the mainbearing axis "MB". The cooperating motion of translation of the grinding wheel 32 together with rotation of the crankshaft 40 results in the crankpin 44 moving relative to the grinding wheel 32 reciprocally along an arcuate path "T" having a radius "$r_T$" centered on the wheel axis "G". That is, the grinding wheel 32 (and the wheelhead 30 to which the grinding wheel 32 is mounted) "sees" the crankpin 44 moving reciprocally up and down along the arcuate path "T". The grinding wheel-workpiece contact point "P", then, travels along a similar reciprocating path (not shown) on the outer surface of the grinding wheel 32.

As mentioned above, during grinding operations where the grinding wheel-workpiece contact point does not change substantially (such as where constant cross-section workpieces are being machined), certain devices, such as coolant nozzles, may be mounted in fixed relation to the wheelhead and will operate at all times during the machining cycle for their intended purpose. However, it has been observed that during machining operations where the grinding wheel-workpiece contact point changes substantially (such as where eccentric or non-constant cross-section workpieces are being machined), those same devices may not operate for their intended purpose at all times during the machining cycle. Accordingly, it is desirable to provide an apparatus for mounting a device to a grinding machine such that the device operates for its intended purpose at substantially all times during the machining cycle.

It also has been observed that the operation and performance of some devices, such as in-process gauges and/or workpiece supports, which are intended to engage the workpiece directly during the machining operation are enhanced if the motion of the device resembles motion of the workpiece relative to the wheelhead. For example, U.S. Pat. No. 6,067,721 to Dall'Aglio, et al., teaches an in-process gauge mounted to a wheelhead of a grinding machine for positioning the gauge near an orbiting workpiece. The apparatus of Dall'Aglio '721, however, does not pivot directly about the center of the arcuate path along which the workpiece travels relative to the grinding wheel. As such, the apparatus consists of a complex linkage which is constrained in its motion and requires superfluous degrees of motion (relative to the workpiece) in which to operate. It is desirable therefore to provide an apparatus for mounting a device to a grinding machine such that the orientation and motion of the device mimics the orientation and motion of the workpiece during the machining cycle.

It is desirable furthermore to provide an apparatus for mounting a device to a grinding machine such that the orientation and motion of the device mimics the orientation and motion of the workpiece during the machining cycle, wherein the workpiece travels along an orbital or eccentric path during the machining cycle.

It is desirable furthermore to provide an apparatus for mounting a device to a grinding machine adapted to machine selected portions of crankshafts and of other orbiting and eccentric workpieces.

It is desirable furthermore to provide an apparatus for delivering coolant to a machining zone of a grinding machine.

It is desirable furthermore to provide an apparatus for positioning a workpiece support device near a workpiece being machined.

It is desirable furthermore to provide an apparatus for positioning an in-process gauge device near a workpiece being machined.

It is desirable furthermore to provide an apparatus for positioning various devices near a workpiece during machining operations such that the device maintains contact with the workpiece for substantially the entire machining operation.

It is desirable furthermore to provide an apparatus for positioning various devices near a workpiece during machining operations, wherein the apparatus is adapted to manually or automatedly disengaged the workpiece when commanded.

It is even further desirable to provide an apparatus for positioning various devices near a workpiece during machining operations, wherein motion of the apparatus has a minimum number of degrees of freedom with reference to motion of the workpiece, and preferably, has only a single degree of freedom with reference to motion of the grinding machine or a portion thereof, such as the wheelhead.

SUMMARY OF THE INVENTION

The present invention provides an apparatus for positioning a device, such as a coolant nozzle, an in-process gauge, a workpiece support, the like or any combination of the foregoing, near a workpiece during a machining operation.

It is an object of the present invention to provide an apparatus for mounting a device to a grinding machine such that the device operates for its intended purpose at substantially all times during the machining cycle.

It is another object of the present invention to provide an apparatus for mounting a device to a grinding machine such that the orientation and motion of the device mimics the orientation and motion of the workpiece during the machining cycle.

It is still another object of the present invention to provide an apparatus for mounting a device to a grinding machine such that the orientation and motion of the device mimics the orientation and motion of the workpiece during the machining cycle, wherein the workpiece travels along an orbital or eccentric path during the machining cycle.

It is yet another object of the present invention to provide an apparatus for mounting a device to a grinding machine adapted to machine selected portions of crankshafts and of other orbiting and eccentric workpieces.

It is yet still another object of the present invention to provide an apparatus for delivering coolant to a machining zone of a grinding machine.

It is even further another object of the present invention to provide an apparatus for positioning a workpiece support device near a workpiece being machined.

It is yet even still further another object of the present invention to provide an apparatus for positioning an in-process gauge device near a workpiece being machined.

It is still another object of the present invention to provide an apparatus for positioning various devices near a workpiece during machining operations such that the device maintains contact with the workpiece for substantially the entire machining operation.

It is yet another object of the present invention to provide an apparatus for positioning various devices near a workpiece during machining operations, wherein the apparatus is adapted to manually or automatedly disengaged the workpiece when commanded.

It is still yet another object of the present invention to provide an apparatus for positioning various devices near a workpiece during machining operations, wherein motion of the apparatus has a minimum number of degrees of freedom with reference to motion of the workpiece, and preferably, has only a single degree of freedom with reference to motion of the grinding machine or a portion thereof, such as the wheelhead.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

According to one embodiment of the present invention, an apparatus is mounted to a machine for positioning a device near a workpiece during a machining operation, during which the workpiece is movable relative to a machining tool. The apparatus comprises an arm coupled to the machining tool and movable relative thereto to mimic movement of the workpiece relative to the machining tool. The arm includes a shoe for contacting the workpiece during the machining operation. The apparatus further comprises a linear actuator coupled to the arm for moving the arm between a retracted position and an engaged position. According to one embodiment of the present invention, the apparatus includes a coolant nozzle assembly. According to another embodiment of the invention, the apparatus includes a workpiece support shoe. According to still another embodiment of the present invention, the apparatus includes an in-process gauge assembly.

BRIEF DESCRIPTION OF THE DRAWINGS

A better understanding of the invention will be had upon reference to the following description in conjunction with the accompanying drawings in which like reference numerals represent like parts, and wherein.

Figure 1:
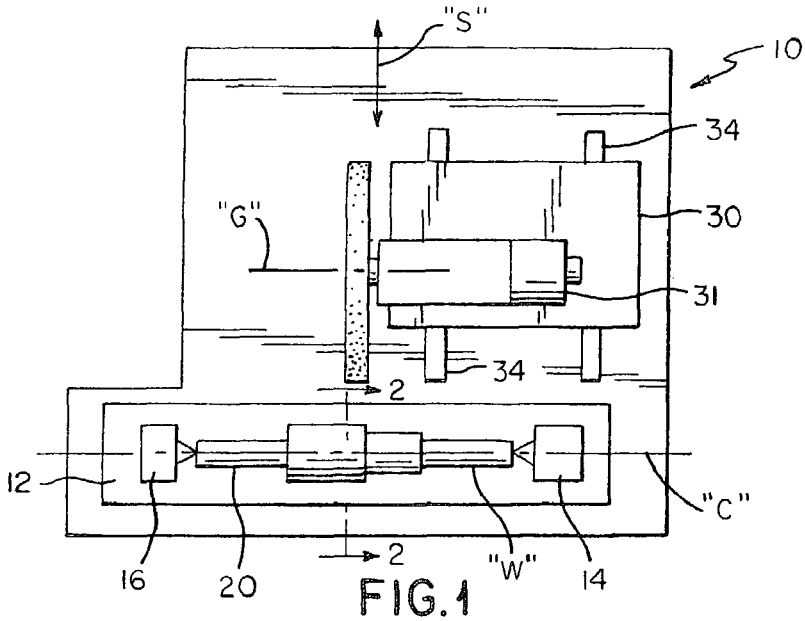
FIG. 1 (PRIOR ART)
FIG. 1 is a plan view schematic representation of a prior art grinding machine showing a workpiece having a series of stepped constant cross-section portions mounted thereon.
Figure 2:
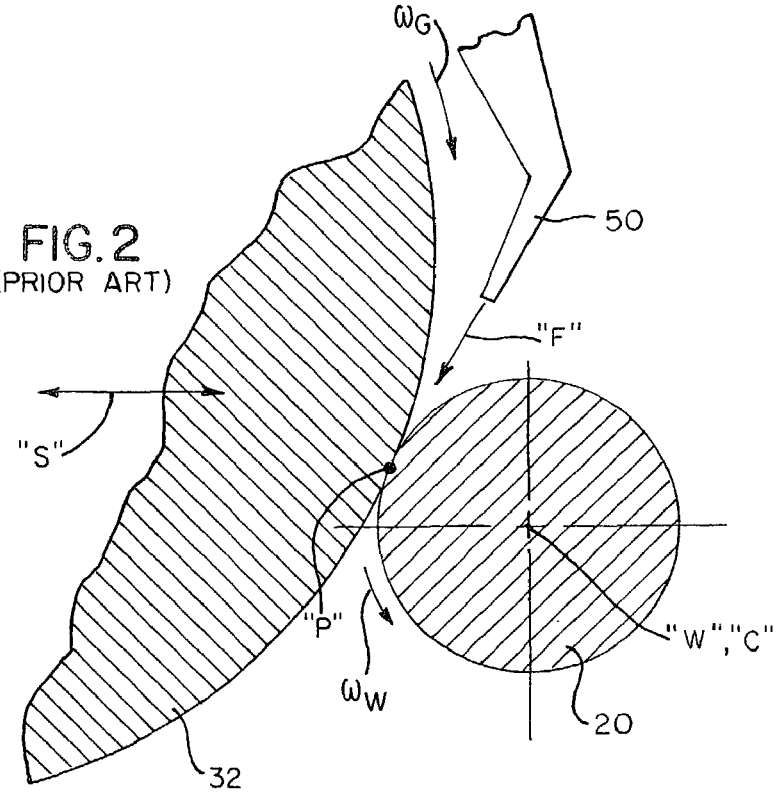
FIG. 2 (PRIOR ART)
FIG. 2 is a close-up side view schematic representation of portions of the grinding machine of FIG. 1, shown along section line 2-2 of FIG. 1, showing a grinding wheel of the grinding machine contacting an outer surface of the workpiece.

Reference numerals are used throughout the within description to illustrate exemplary embodiments of the present invention, with reference to the various Figures, as follows:

100—apparatus according to an embodiment of the present invention;
110—primary arm;
112—rocker end of primary arm;
113—circular opening of rocker end;
113*a*—step in circular opening of rocker end;
114—inner ring of bearing assembly;
114*a*—step in inner ring of bearing assembly;
115—outer ring of bearing assembly;
115*a*—step in outer ring of bearing assembly;
116—bearing or bearing assembly;
118—extension arm of primary arm;
120—distal end of primary arm;
120*a*—throughbore of distal end of primary arm;
125—forked shoulder portion of rotatable arm;
126—arm of primary arm
127—forked end of rotatable arm;
128—wheel;
129—pin;
130—mounting block;
130*a*—throughbore of mounting block;
140—secondary arm;
141—upper end of secondary arm;
141*a*—throughbore of upper end of secondary arm;
142—lower end of secondary arm;
149—wear-resistant shoe;
150—first linear actuator;
151—stationary portion of first linear actuator;
152—extendable portion of first linear actuator;
154—plunger of first linear actuator;
160—coolant nozzle assembly;
161—upper end of main body of coolant nozzle assembly;
162—inlet in upper end of main body of coolant nozzle assembly;
163—lower end of main body of coolant nozzle assembly;
164—main body of coolant nozzle assembly;
200—apparatus according to an alternative embodiment;
255—second linear actuator;
255*a*—stationary portion of second linear actuator;
255*b*—extendable portion of second linear actuator;
256—clevis;
270—support arm;
272—bearing;
274—pin;
274*a*—first end of pin;
274*b*—second end of pin;
275—collar;
276—upper end of support arm;
277—lower end of support arm;
277*a*—first pad of support arm;
277*b*—second pad of support arm;
278—support shoe;
280—lever arm;
281—upper end of lever arm;
300—apparatus according to an alternative embodiment;
390—in-process gauge assembly;

392—in-process gauge;
392*a*—first finger of in-process gauge;
392*b*—second finger of in-process gauge;
394—mounting bracket;
394*a*—upright portion of mounting bracket;
394*b*—forward portion of mounting bracket;
396*a*—first leaf spring;
396*b*—second leaf spring; and,
400—apparatus according to an alternative embodiment.

DETAILED DESCRIPTION OF THE PREFERRED EMBODIMENTS

Figures 6, 6A:
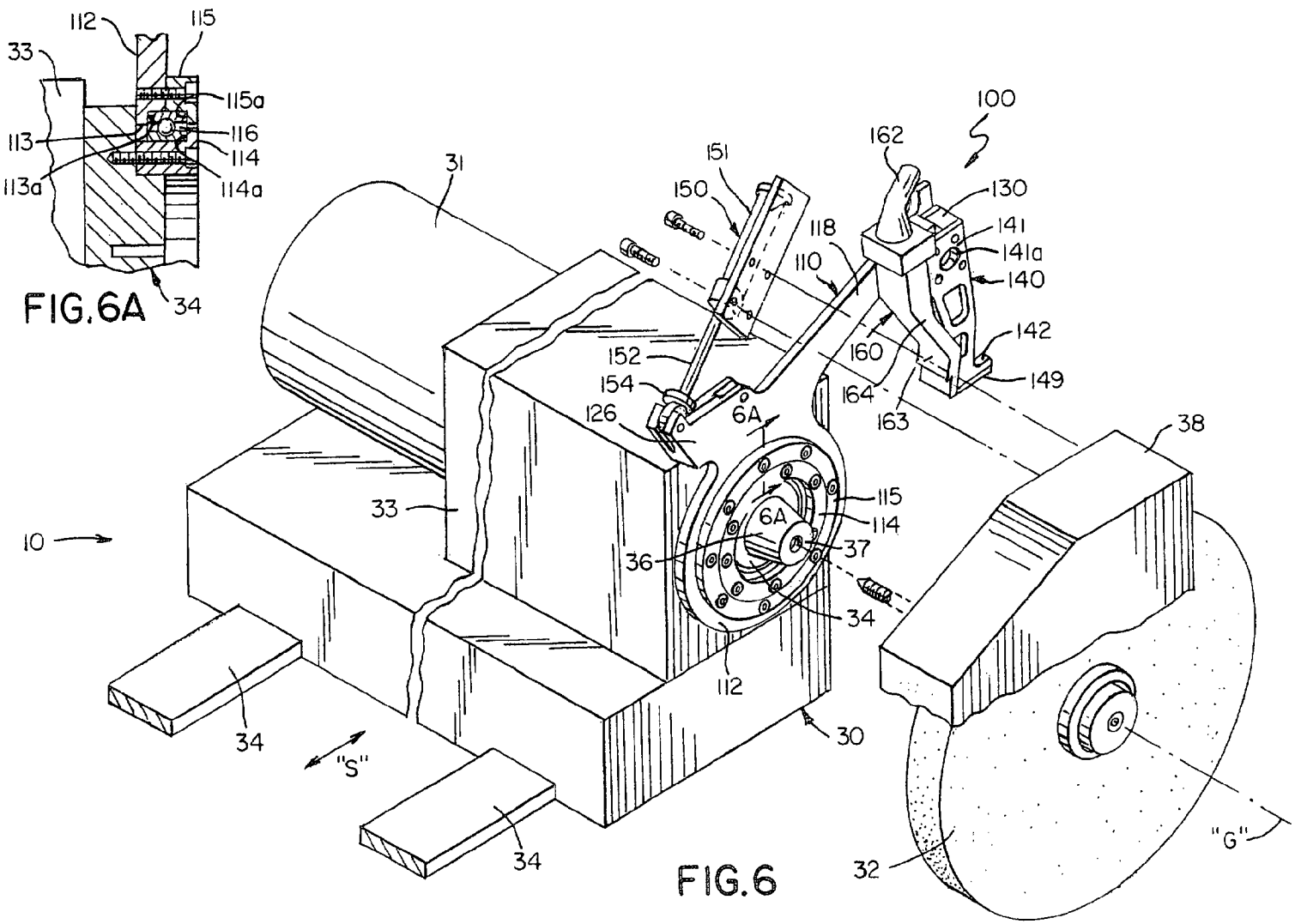
FIG. 6 is a rear perspective view schematic representation of an apparatus according to a preferred embodiment of the present invention shown mounted to the prior art grinding machine of FIG. 3 and shown in a retracted position.
FIG. 6A is a partial detail section view of a portion of the apparatus of FIG. 6 shown mounted to the prior art grinding machine of FIG. 3, and shown along section line 6A-6A of FIG. 6.

With reference to FIG. 6, an apparatus 100 according to a preferred embodiment of the present invention is shown mounted to the wheelhead 30 of a typical prior art grinding machine 10 located along the wheel axis "G" between the wheelhead 30 and the grinding wheel 32. As will be described in detail below, the apparatus 100 is adapted to mimic reciprocating motion of a portion of the workpiece being ground, for example, orbiting motion of a crankpin 44 (FIG. 9) of a crankshaft 40 (FIG. 9) as the crankpin 44 (FIG. 9) moves along a predefined arcuate path "T" (FIG. 9) relative to the grinding wheel 32 during machining operations.

Figure 7:
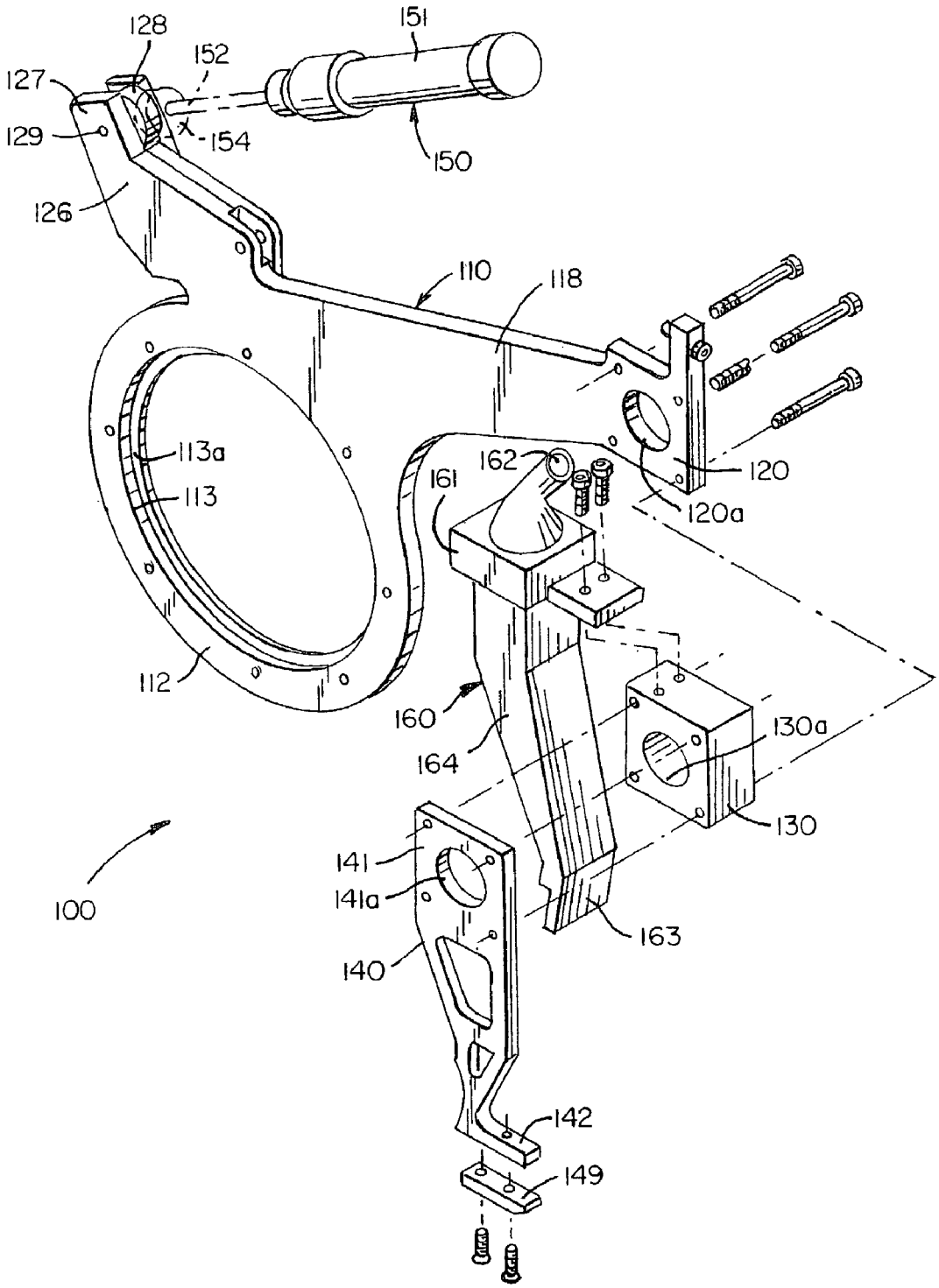
FIG. 7 is an exploded front perspective view of the apparatus of FIG. 6.

With additional reference now to FIG. 7, the apparatus 100 includes a primary arm 110, a secondary arm 140, a linear actuator 150 and a coolant nozzle assembly 160. The primary arm 110 is of a generally plate-like construction formed, for example, from {fraction (½)} inch thick aluminum plate, and includes a rocker end 112, an extension arm 118 extending forwardly from the rocker end 112 and an arm 126 extending upwardly from the rocker end 112 and forming an angle with the extension arm 118. It should be understood that terms such as "forwardly", "rearwardly" and "upwardly" are to be interpreted herein with reference to the apparatus 100 being mounted relative to the wheelhead 30 in the orientation shown in the Figures and that such terms may take on different meanings, for example, if the orientation of the apparatus 100 is changed relative to the wheelhead 30.

With additional reference now to FIG. 6A, spindle 31 is mounted securely to the wheelhead 30, such as by a rigid housing 33, and includes a nose end 34 at one end thereof. The nose end 34 of the spindle 31 includes a rotating center portion 36 extending therefrom which is adapted to securely receive the grinding wheel 32 thereon for unitary, high-speed, powered rotation therewith about the grinding wheel axis "G". The spindle 31 is constructed such that center portion 36 rotates within the spindle nose end 34, which is mounted non-rotatably relative to the housing 31, and as such, the nose end 34 provides a stationary surface upon which the apparatus 100 may be mounted to the wheelhead 30. Rocker end 112 includes a generally circular opening 113 sized to fit around the nose section 34 of the spindle 31.

Preferably, rocker end 112 is mounted to the nose section 34 of the spindle 31 by a bearing assembly comprising an inner ring 114, an outer ring 115 and a conventional bearing 116 positioned between the inner and outer rings 114, 115, respectively, for relative rotational movement therebetween. Bearing 116 may take any conventional form, for example, a ball bearing, roller bearing, sleeve bearing, fluid film bearing or bushing. The outer ring 115 is affixed, such as by bolting, to an outer face of the rocker end 112, and the inner ring 114 is affixed, such as by bolting, to an outer face of the nose section 34. Bearing 116 is captured between a step 113*a* in the rocker end opening 113 and steps 114*a*, 115*a* in the inner and outer rings 114 and 115, respectively. Primary arm 110, therefore, is adapted to rotate on the bearing 116 about the grinding wheel axis "G". Primary arm 110 may alternatively be mounted to the wheelhead 30 on one or more simple rollers (not shown).

Secondary arm 140 is fixedly mounted, such as by one or more bolts, to a distal end 120 of the primary arm 118 and is oriented relative thereto to depend downwardly therefrom. A mounting block 130 is sandwiched between the distal end 120 of the primary arm 118 and an upper end 141 of the secondary arm 140 and provides a surface to which the coolant nozzle assembly 160 may be mounted, as will be described in greater detail below. A wear-resistant shoe 149 constructed out of, for example, polycrystalline diamond or carbide, is affixed to the lower end 142 of the secondary arm 140, such as by one or more bolts, and is constructed from a material suitable to permit riding of the shoe 149 against the rotating surface of the crankpin 44 (FIG. 9), as will be described in greater detail below. Alternatively, shoe 149 may be omitted altogether, for example, where secondary arm 140 (or the lower end 142 thereof) is constructed from a suitable wear-resistant material.

Coolant nozzle assembly 160 includes a main body 164 formed from hollow tubing material which includes an upper end 161 having an inlet 162 and a lower end 163 defining an outlet for projecting a flow of coolant therefrom. The main body 164 may be configured to alter the flow characteristics of the coolant flowing therethrough. For example, the lower end 163 of the main body 164 may have a cross sectional area which is less than the cross sectional area of the upper end 161 of the main body 164, thereby increasing the velocity at which coolant flows through the main body 164 and is projected from the lower end 163 outlet thereof. Although the coolant nozzle assembly 160 has been described herein with reference to a single main body 164, one or more main nozzle bodies, outlets or orifices may be provided alternatively without departing from either the spirit or the scope of the present invention.

It will be appreciated that although the primary arm 110, secondary arm 140 and coolant nozzle assembly 160 shown are formed from individual components bolted together to define a unitary construction, the components thus described may alternatively take the form of a single-piece construction sized, shaped and configured to function as described herein.

Linear actuator 150 is preferably a conventional bi-directional rod-and-cylinder fluid-controlled device having a stationary portion 151 fixedly connected, such as by bolting, to the wheelhead 30, for example, to a wheel fender 38 surrounding at least a portion of the grinding wheel 32. Alternatively, stationary portion 151 of linear actuator 150 may be affixed to a bracket (not shown) mounted directly to the spindle housing 33. Preferably, stationary portion 151 of the linear actuator 150 is a cylinder portion of a conventional hydraulic or pneumatic cylinder device. An extendable portion 152 of the linear actuator 150 is linearly movable relative to the stationary portion 151 and includes a plunger 154 at a distal end thereof. Actuation of the linear actuator 150 causes the extendable portion 152 to move controllably towards and away from the stationary portion 151, thereby decreasing or increasing the overall length of the linear actuator 150.

Arm 126 includes a forked end 127 sized and configured to receive a small wheel 128 therein rotatable on, for example, a pin 129. As is shown clearly in FIG. 6, the linear actuator 150 is mounted to the wheelhead 30 such that its orientation allows for the extendable portion 152 to contact the wheel 128 held in the forked end 127 of the arm 126 when the extendable portion 152 is extended from the stationary portion 151 and to withdraw completely from the wheel 128 when the extendable portion 152 is withdrawn completely within the stationary portion 151. In this manner, linear actuator 150 may cause rotation of the primary arm 110 (and thus of the secondary arm 140 and coolant nozzle assembly 160 affixed thereto) on the bearing 116 about the grinding wheel axis "G".

Figure 8:
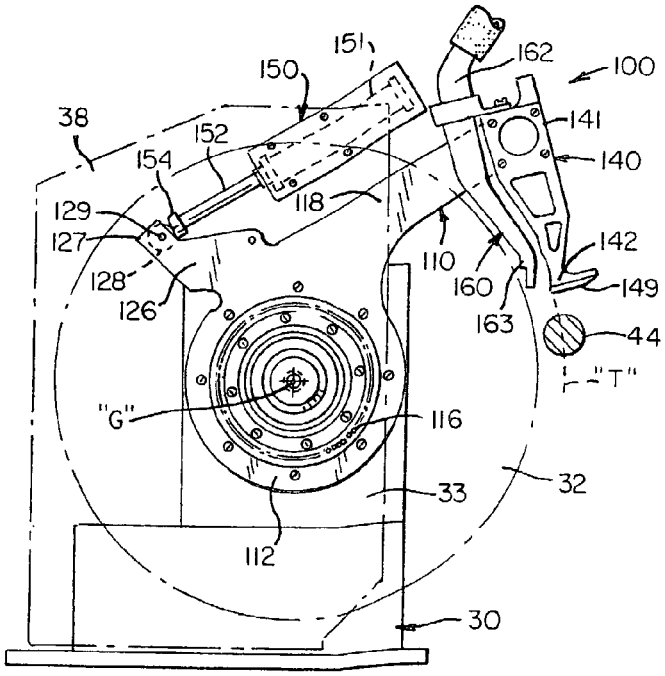
FIG. 8 is a side view schematic representation of the apparatus of FIG. 6 shown in a retracted position.
Figure 9:
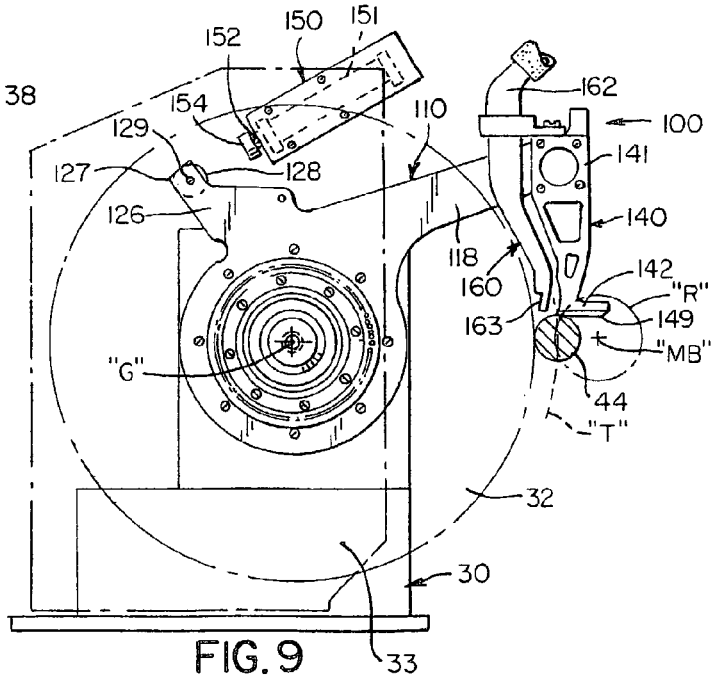
FIG. 9 is a side view schematic representation of the apparatus of FIG. 6, shown in an engaged position.

Referring now to FIGS. 8 and 9, operation of the apparatus 100 will be described with exemplary reference to a crankpin 44 grinding operation. FIG. 8 shows the apparatus 100 in a retracted position, caused by extension of the extendable portion 152 of the linear actuator 150 to an extended position whereat the plunger 154 engages the wheel 128 held within the forked end 127 of the arm 126 and rotates the primary arm 110 (with the secondary arm 140 and the coolant nozzle assembly 160 affixed thereto as described above) about the grinding wheel axis "G" so that the shoe 149 is lifted off of and away from the crankpin 44 a sufficient distance so as to permit rotation of the crankpin 44 about the mainbearing axis "MB" without contacting the shoe 149 and so as to not interfere with removal of the crankshaft from the grinding machine following a machining operation.

FIG. 9 shows the apparatus 100 in an engaged position, caused by retraction of the extendable portion 152 of the linear actuator 150 such that the primary arm 110 (with the secondary arm 140 and the coolant nozzle assembly 160 affixed thereto as described above) rotates under its own weight about the grinding wheel axis "G" until the shoe 149 rests on the surface of the crankpin 44.

As the crankpin 44 orbits around the mainbearing axis "MB" during a typical machining operation, the crankpin 44 will follow the circular path "R" about the mainbearing axis "MB", which is "viewed" by the grinding wheel 32 relationally as traveling along the arcuate path "T". The weight of the primary arm 110, the secondary arm 140, the coolant nozzle assembly 160 and the linear actuator 150, normally, are sufficient to cause the apparatus 100 to rise and fall with the crankpin 44 as is travels along the arcuate path "T". Primary arm 110, then, may be seen to rotatably oscillate about the grinding wheel axis "G", whereby the wheel 128 held within the forked end 127 of the arm 126 will move towards and away from the retracted plunger 154 of the linear actuator 150. It is preferable, therefore, that the linear actuator 150 be positioned sufficiently far from the arm 126 (and have a sufficiently long stroke relative thereto) so as to permit oscillation of the primary arm 110 between retracted and engaged positions without causing interference. Because the apparatus 100 moves about the same axis (i.e., the grinding wheel axis "G") as the crankpin 44 moves (relative to the grinding wheel 32) during a machining operation, the apparatus 100 closely mimics motion of the crankpin 44 relative to the grinding wheel 32, thereby permitting the coolant nozzle assembly 160, and particularly, the lower end 163 outlet of the coolant nozzle main body 163, to direct coolant towards the point of contact "P" between the grinding wheel 32 surface and the crankpin 44 surface at substantially all times during machining operations.

Figure 10:
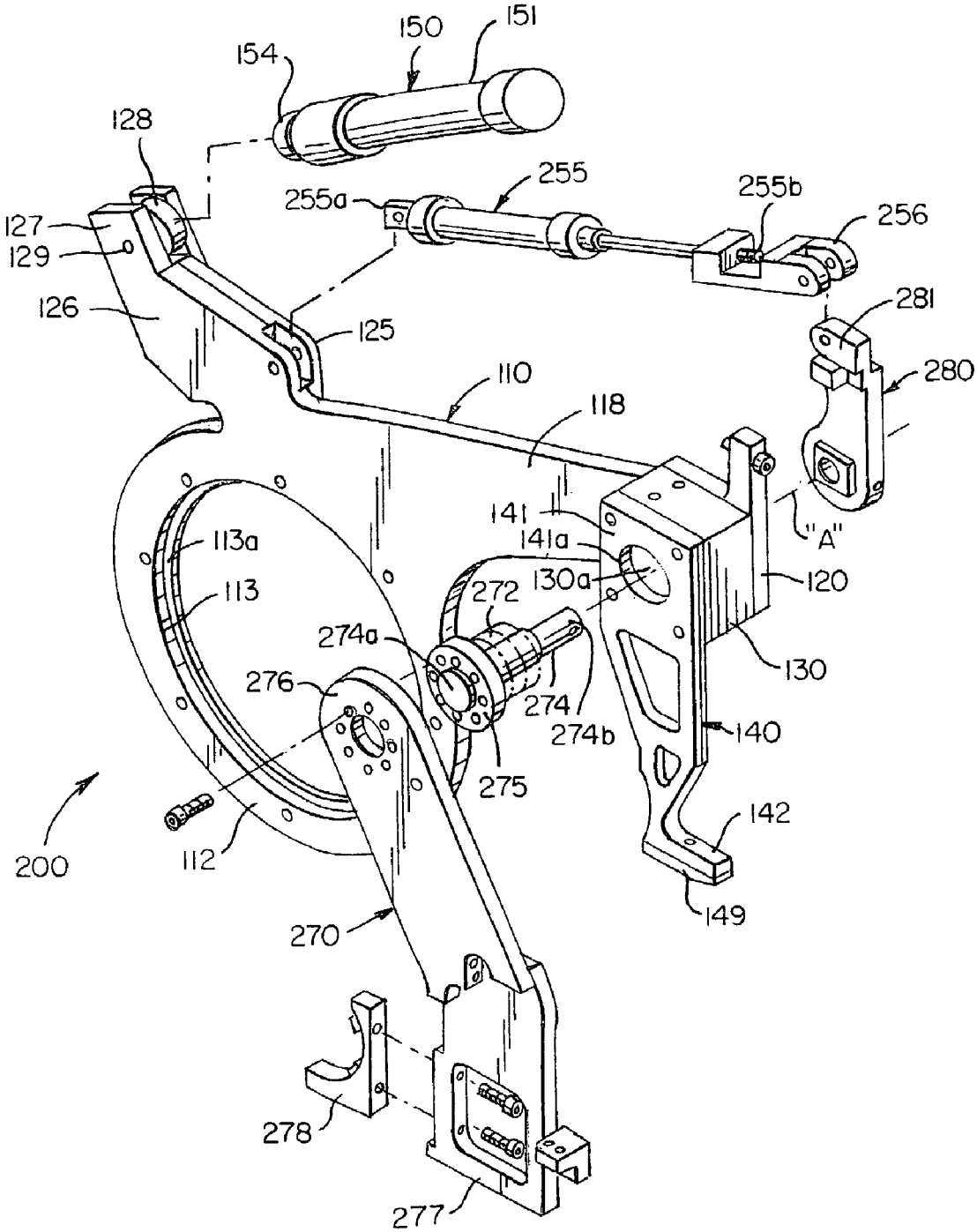
FIG. 10 is an exploded front perspective view of an apparatus according to an alternative embodiment of the present invention.
Figure 11:
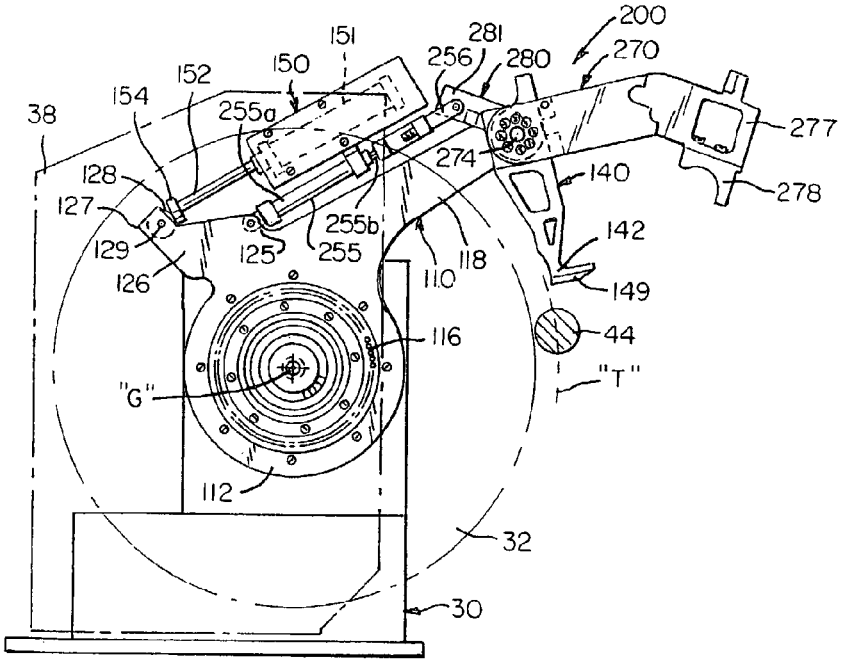
FIG. 11 is a side view schematic representation of the apparatus of FIG. 10 shown in a retracted position.
Figure 12:
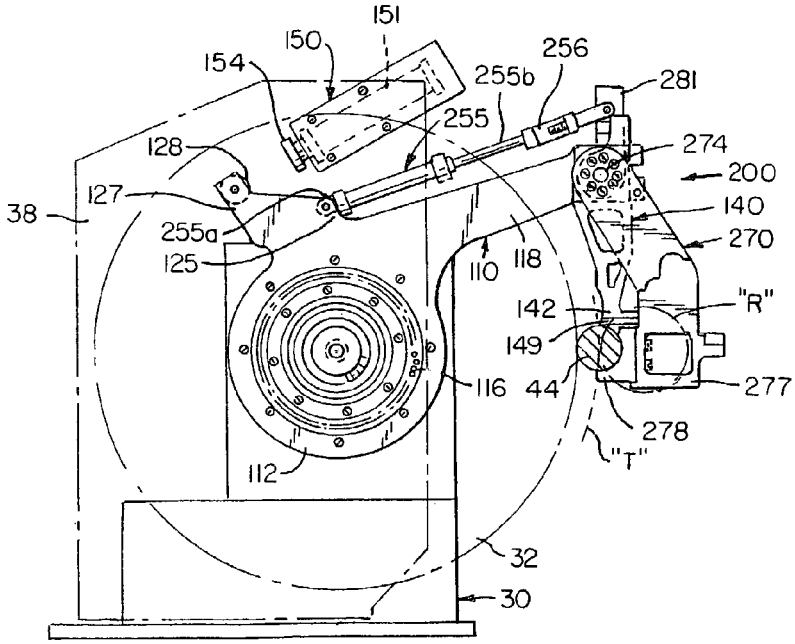
FIG. 12 is a side view schematic representation of the apparatus of FIG. 10 shown in an engaged position.

With reference now to FIGS. 10-12, an apparatus 200 according to a first alternative embodiment of the present invention is shown and includes many components in common with the apparatus 100 (FIGS. 7-9) according to the preferred embodiments hereof and like reference numerals are intended to represent like components. However, the apparatus 200 according to the present embodiment further includes a support arm 270 and a second linear actuator 255. The support arm 270 and the second linear actuator 255 cooperate, with the apparatus 100 of the preferred embodiment described above to also support the crankpin 44 (and the crankshaft 40) from flexure due to radial loading by the grinding wheel 32 on the crankpin 44 during machining operations.

Referring back to FIG. 7 momentarily, upper end 141 of secondary arm 140, mounting block 130 and distal end 120 of the primary arm 118 are each provided with a throughbore 141*a*, 130*a*, 120*a*, respectively, which are aligned along an arm axis "A" (FIG. 10) when the apparatus 100 is assembled as shown in FIG. 6 to receive a conventional bearing 272 therethrough. A pin 274 is received through the bearing 272 and is thereby rotatable relative to the apparatus 200 about the arm axis "A". Pin 274 includes a first end 274*a* to which an upper end 276 of the support arm 270 may be affixed, such as by bolting upper end 276 to a collar 275, which is itself clamped or otherwise secured, such as by a setscrew or key, to the pin 274. The support arm 270, therefore, is rotatable relative to the secondary arm 140 on bearing 272 as pin 274 rotates within the bearing 272. A lever arm 280 is clamped or otherwise secured to, such as by a setscrew or key, to a second end 274*b* of the pin so that the distal end 120 of the primary arm 118, the mounting block 130 and the secondary arm 140 are sandwiched between the lever arm 280 and the support arm 270. Because the support arm 270 and the lever arm 280 are both secured to the pin 274, support arm 270, lever arm 280 and pin 274 rotate as a unit on bearing 272 relative to the secondary arm 140.

Second linear actuator 255 is preferably a conventional bi-directional rod-and-cylinder fluid-controlled device having a stationary portion 255*a* thereof pivotably connected, such as by a pin (not shown), to a forked shoulder portion 125 of the arm 126. Second linear actuator 255 also includes an extendable portion 255*b* linearly movable relative to the stationary portion 255*a* and pivotably connected to an upper end 281 of the lever arm 280, such as by a clevis 256 threadingly received on a distal end of the extendable portion 255*b* of the second linear actuator 255. Preferably, the stationary portion 255*a* of the linear actuator 255 is a cylinder portion of a conventional hydraulic or pneumatic cylinder device and the extendable portion 255*b* of the linear actuator 255 is a rod portion of the conventional hydraulic or pneumatic cylinder device. Second linear actuator 255, then, may cause rotation of the support arm 270 by extending and retracting the extendable portion 255*b* thereof.

A lower end 277 of the support arm 270 includes a support shoe 278 constructed from a wear-resistant material, such as polycrystalline diamond or carbide, suitable to permit riding of the support shoe 278 against the rotating surface of the crankpin 44 (FIG. 12), as will be described in greater detail below. Support shoe 278 is preferably bolted to the lower end 277 of the support arm 270 so as to allow for removal and replacement thereof from time to time. Alternatively, shoe 278 may be integrally formed with the support arm 270, for example, at the lower end 277 thereof, in which case, the support arm 270 (or the lower end 277 thereof) may be constructed out of a suitable wear-resistant material.

Figure 3:
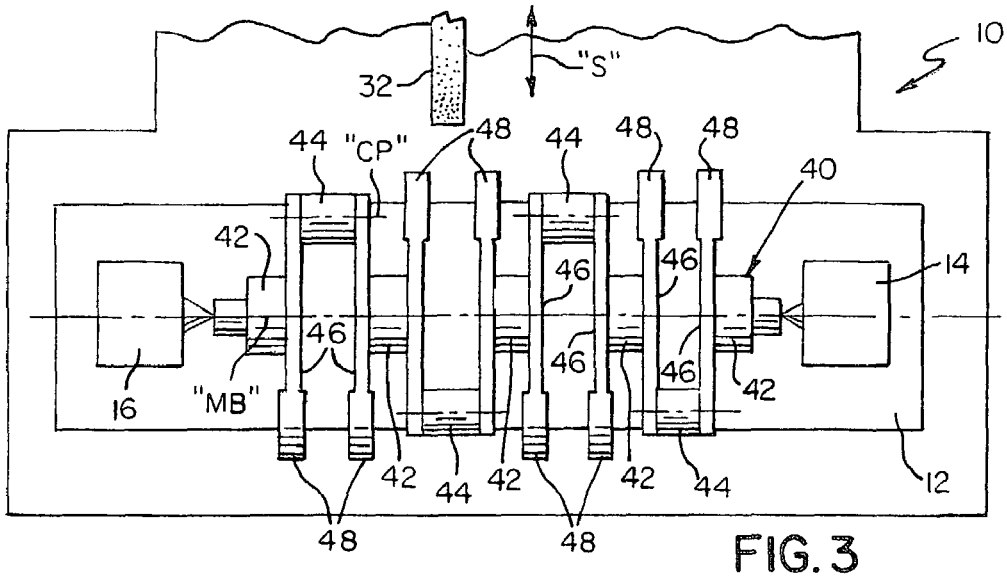
FIG. 3 (PRIOR ART)
FIG. 3 is a plan view schematic representation of the prior art grinding machine of FIG. 1 showing a prior art crankshaft mounted thereon.
Figure 4:
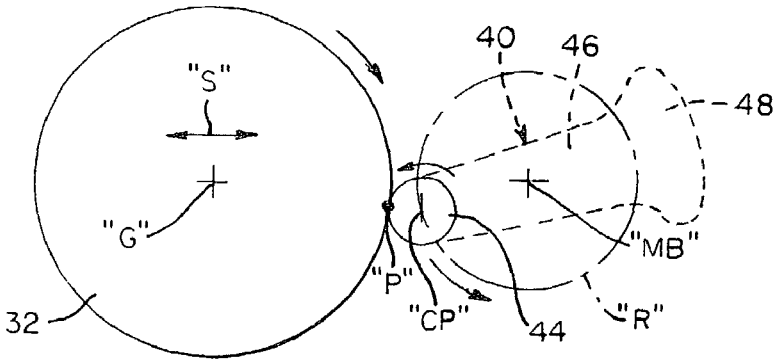
FIG.4 (PRIOR ART)
FIG. 4 is a kinematic diagram showing motion of a crankpin portion of the prior art crankshaft of FIG. 3 orbiting around a main bearing axis of the crankshaft and showing a grinding wheel portion of the prior art grinding machine of FIG. 3 engaging the crankpin at a contact point.
Figure 5:
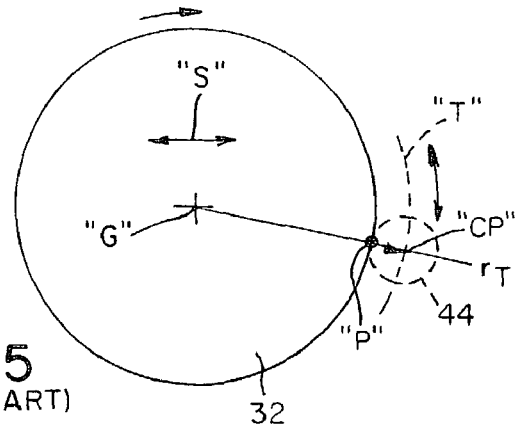
FIG.5 (PRIOR ART)
FIG. 5 is a kinematic diagram showing motion of a crankpin axis of the crankpin of FIG. 4, relative to the grinding wheel of FIG. 4.

With specific reference now to FIGS. 11 and 12, operation of the apparatus 200 according to the present embodiment hereof will be described with exemplary reference to a crankpin 44 grinding operation. Prior to the grinding operation, a crankshaft 40 (FIG. 3) is mounted between the headstock 14 (FIG. 3) and the footstock 16 (FIG. 3) for rotation about the mainbearing axis "MB". As described above, crankpin 44 will orbit around the mainbearing axis "MB" along a generally circular path "R". Prior to mounting the crankshaft 40 between the headstock and footstock 14, 16, respectively, the apparatus 200 is moved to its fully retracted orientation whereat both the first linear actuator 150 is extended so as to lift the shoe 149 upwardly and whereat the second linear actuator 255 is retracted so as to pivot the support shoe 278 forwardly and upwardly (away from the crankpin 44). In this orientation, both the second arm 140 and the support arm 270 are moved away from the general location of the machining zone. Once the crankshaft 40 is mounted, the crankshaft 40 can be rotated about the mainbearing axis "MB" so as to position the crankpin 44 in a location shown generally in FIG. 11.

The first linear actuator 150 is retracted, thereby causing the apparatus 200 to rest on the surface of the crankpin 44, such as by shoe 149. The second linear actuator 255 is extended, thereby pivoting the support arm 280 about the arm axis "A", until the support shoe 278 rests firmly in front of the crankpin 44. The second linear actuator 255 is then "locked" in this position, thereby providing a substantially unmovable and stiff support to oppose radial loading of the crankpin 44 due to the grinding wheel 32. In the same manner as apparatus 100 of the preferred embodiment hereof allows motion of the coolant nozzle assembly 160 to mimic motion of the crankpin 44 as it traverses along path "T" (relative to the grinding wheel 32), apparatus 200 according to the present embodiment hereof allows motion of the support arm 270 (and of the support shoe 278 affixed thereto) to mimic motion of the crankpin 44 as it traverses the path "T" (relative to the grinding wheel 32).

Figure 13:
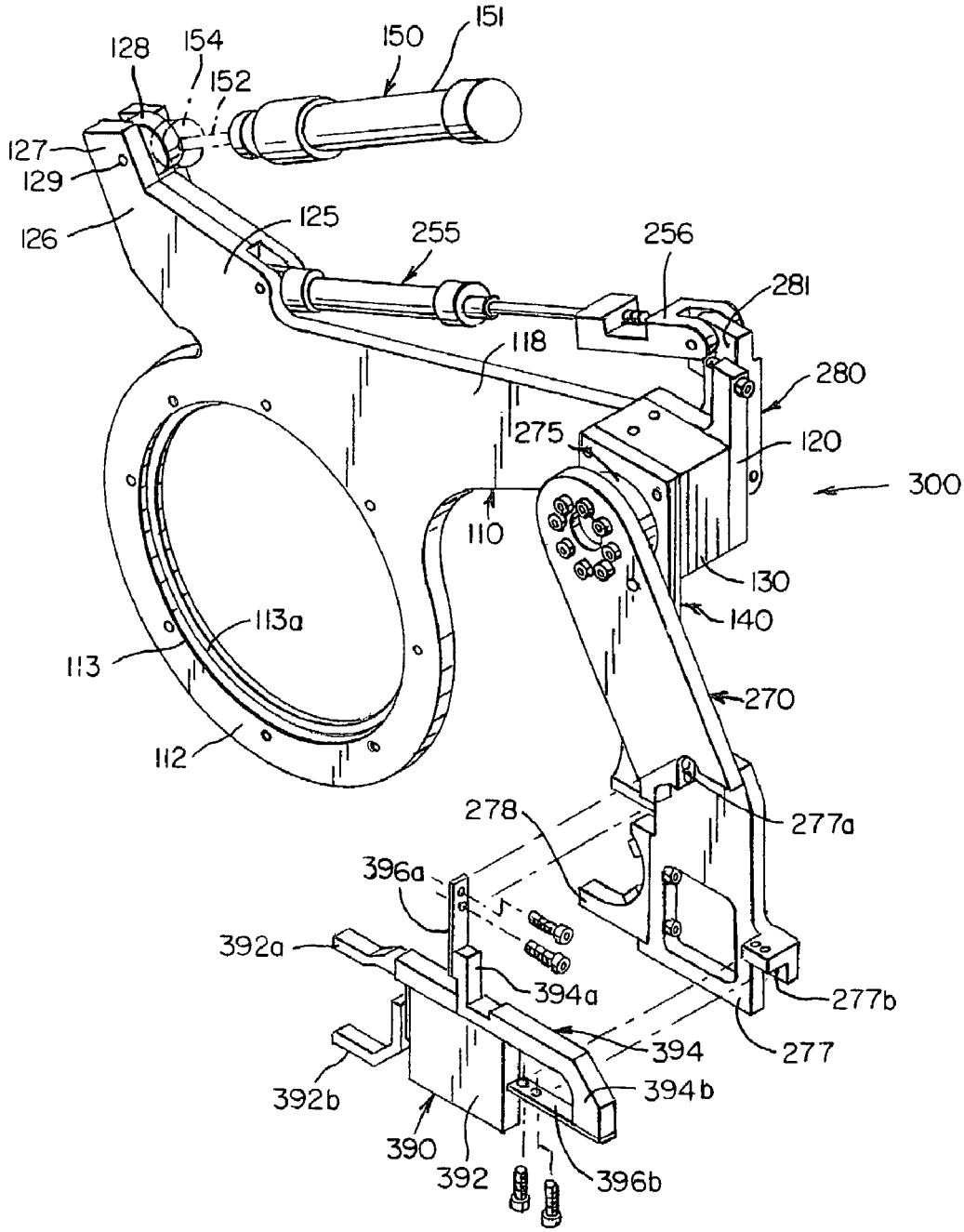
FIG. 13 is an exploded front perspective view of an apparatus according to another alternative embodiment of the present invention.
Figure 14:
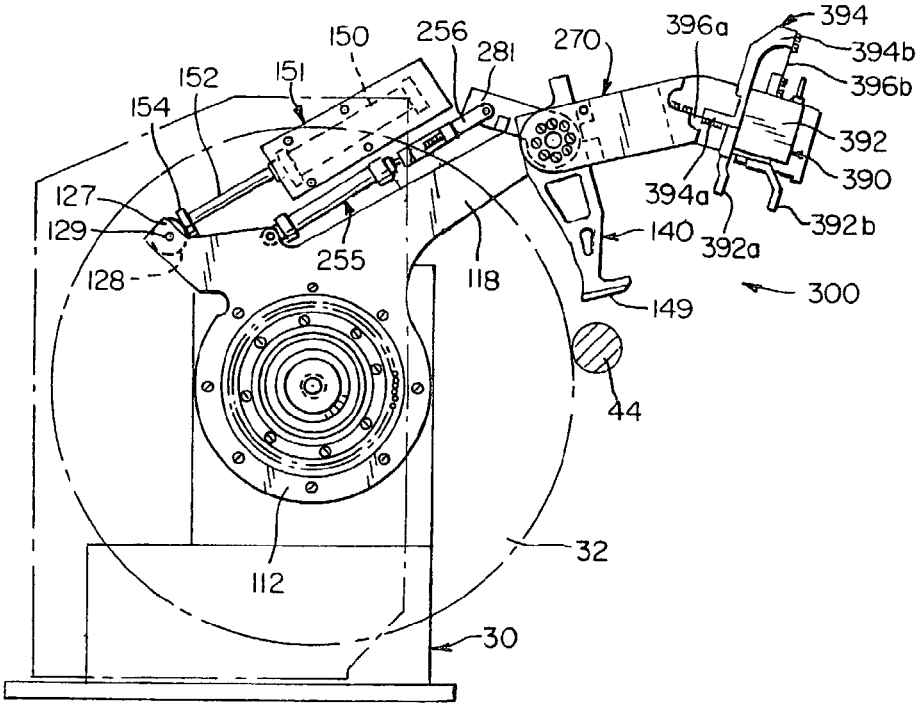
FIG. 14 is a side view schematic representation of the apparatus of FIG. 13 shown in a retracted position.
Figure 15:
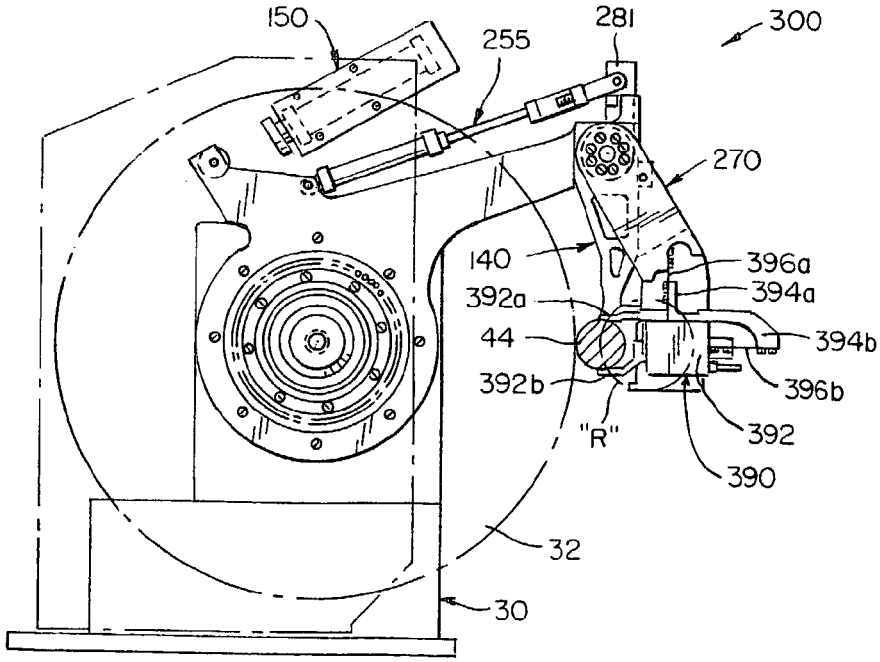
FIG. 15 is a side view schematic representation of the apparatus of FIG. 13 shown in an engaged position.

With reference to FIGS. 13-15, an apparatus 300 according to another alternative embodiment of the present invention includes many components in common with the apparatus 200 (FIGS. 10-12) according to one alternative embodiment hereof and like reference numerals are intended to represent like components. However, the apparatus 300 according to the present embodiment further includes an in-process gauge assembly 390 comprising a conventional electronic in-process gauge 392, a mounting bracket 394 and first and second leaf springs 396*a*, 396*b*, respectively. Gauge 392 is of a typical configuration including first and second protruding fingers 392*a*, 392*b*, respectively, for electronically measuring a diameter of a workpiece (such as a crankpin 44) placed therebetween. For example, the gauge 392 may be of the type manufactured by Marposs Corporation of Auburn Hills, Mich., wherein the first finger 392*a* is stationary and the second finger 392*b* is moveable relative to the first finger 392*a* and coupled thereto with electronic instrumentation to determine the distance therebetween. Similarly, gauge 392 may be of the type manufactured by Control Gaging Inc. of Ann Arbor, Mich. Although gauge 392 is adapted preferably to measure a diametral portion of the workpiece, gauge 392 may be adapted alternatively to measure only an arcuate portion of the workpiece, such as, for example, by using a conventional vee-shaped gauge block (not shown).

Bracket 394 is fixedly secured to the gauge 392, such as by bolting (not shown), and includes an upright portion 394*a* and a forward portion 394*b*. first leaf spring 396*a* is fixedly secured to the upright portion 394*a* of the bracket 394, such as by bolting (not shown), and second leaf spring 396*b* is fixedly secured to the forward portion 394*b* of the bracket, such as by bolting (not shown). The lower end 277 of the support arm 270 includes first and second pads 277*a*, 277*b*, respectively, arranged to have free ends of first and second leaf springs 396*a*, 396*b*, respectively, securely affixed thereto, such as by bolting, so that gauge assembly 390 may be mounted to the lower end 277 of the support arm 270 and allowed to "float" with respect thereto. Fingers 392*a*, 392*b* are positioned side-by-side with the support shoe 278 when the gauge assembly 390 is mounted to the lower end 277 of the support arm 270, thereby allowing the support shoe 278 to ride against the outer surface of the crankpin 44, the diameter of which the in-process gauge 390 is measuring. Alternatively, support shoe 278 may be removed from the lower end 277 of the support arm 277, for example, where it is desirable to measure the diameter of the crankpin 44 but where support for radial flexure is not required.

With specific reference to FIGS. 14 and 15, operation of the apparatus 300 according to the present embodiment hereof will be described with exemplary reference to a crankpin 44 grinding operation. Prior to the grinding operation, a crankshaft 40 (FIG. 3) is mounted between the headstock 14 (FIG. 3) and the rootstock 16 (FIG. 3) for rotation about the mainbearing axis "MB". As described above, crankpin 44 will orbit around the mainbearing axis "MB" along a generally circular path "R". Prior to mounting the crankshaft 40 between the headstock and footstock 14, 16, respectively, the apparatus 300 is moved to its fully retracted orientation whereat both the first linear actuator 150 is extended so as to lift the shoe 149 upwardly and whereat the second linear actuator 255 is retracted so as to pivot the gauge assembly 390 forwardly and upwardly (away from the crankpin 44). In this orientation, both the second arm 140 and the support arm 270 are moved away from the general location of the machining zone. Once the crankshaft 40 is mounted, the crankshaft 40 can be rotated about the mainbearing axis "MB" so as to position the crankpin 44 in a location shown generally in FIG. 14.

The first linear actuator 150 is retracted, thereby causing the apparatus 300 to rest on the surface of the crankpin 44, such as by shoe 149. The second linear actuator 255 is extended, thereby pivoting the support arm 280 about the arm axis "A", until the crankpin 44 is situated between first and second fingers 392*a*, 392*b*, respectively, of the gauge assembly 390. The second linear actuator 255 is then "locked" in this position. In the same manner as apparatus 100 of the preferred embodiment hereof allows motion of the coolant nozzle assembly 160 to mimic motion of the crankpin 44 as it traverses along path "T" (relative to the grinding wheel 32), apparatus 300 of the present embodiment hereof allows motion of the support arm 270 (and of the gauge assembly 390 affixed thereto) to mimic motion of the crankpin 44 as it traverses the path "T" (relative to the grinding wheel 32).

Figure 16:
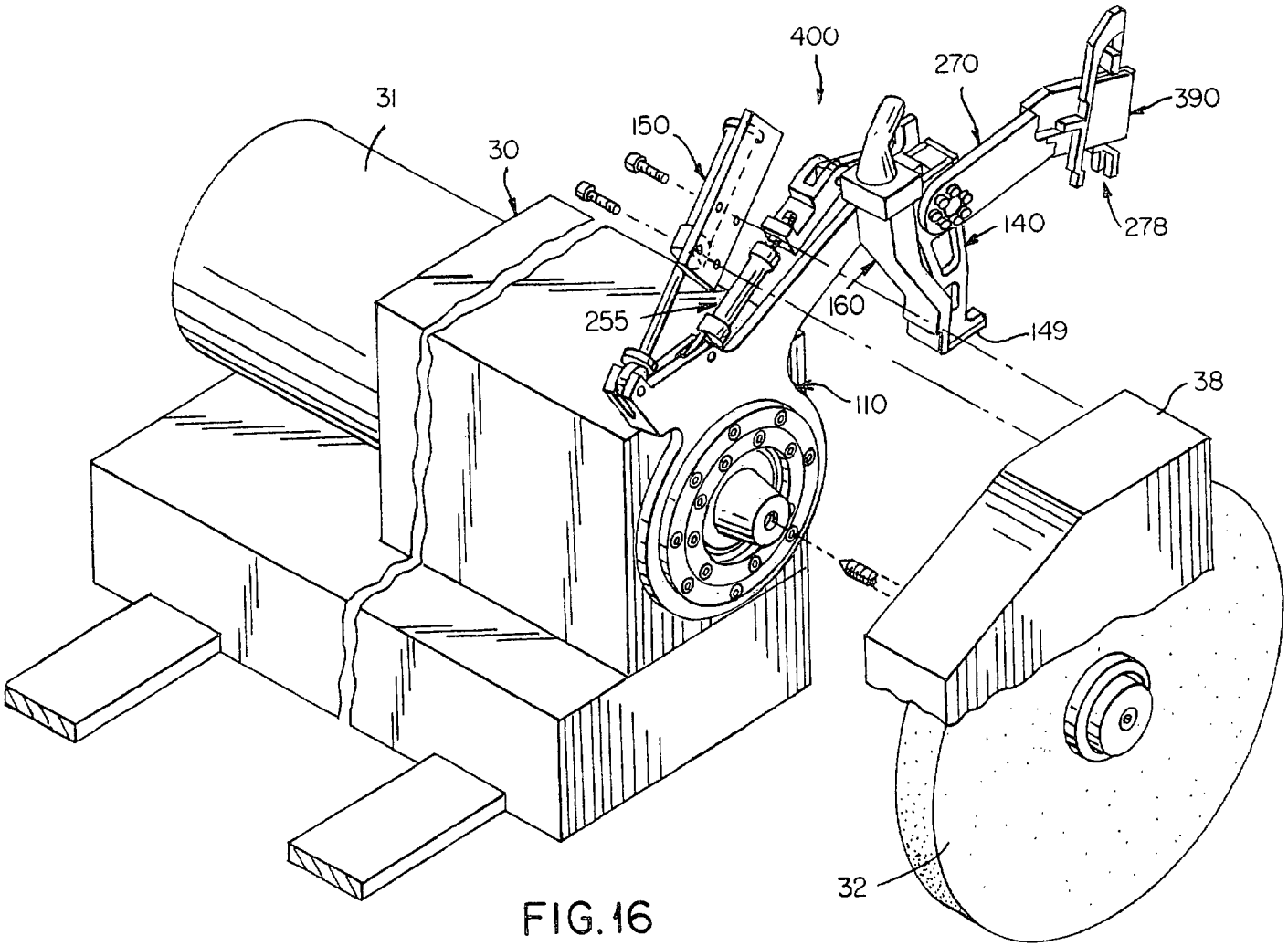
FIG. 16 is a rear perspective view schematic representation of an apparatus according to another alternative embodiment of the present invention; and, FIG. 17 is a rear perspective view schematic representation of an apparatus according to one embodiment of the present invention shown mounted to the prior art grinding machine of Figure according to one alternative method therefor.

With reference to FIG. 16, components of the various embodiments hereof described above may be combined in a number of ways to provide combination functionality. For example, FIG. 16 shows an apparatus 400 mounted to the wheelhead 30 as described above comprising a primary arm 110, a secondary arm 120, a first linear actuator 150, a coolant nozzle assembly 160, a support arm 270, a second linear actuator 255, a support shoe 278 and a gauge assembly 390, all of which are configured and assembled as described, respectively, in the foregoing embodiments hereof. An apparatus 400 thus configured mimics closely the motion of the crankpin 44 (FIG. 14) as heretofore described, provides a flow of coolant over the workpiece, provides support against flexure due to the radial loading by the grinding wheel 32 and provides in-process measurement of the workpiece. Other combinations will be obvious to those of ordinary skill in the art; for example, the coolant nozzle assembly 160 may be removed if coolant flushing is not required, or the gauge assembly 390 may be removed is in-process workpiece measurement is not required.

Figure 17:
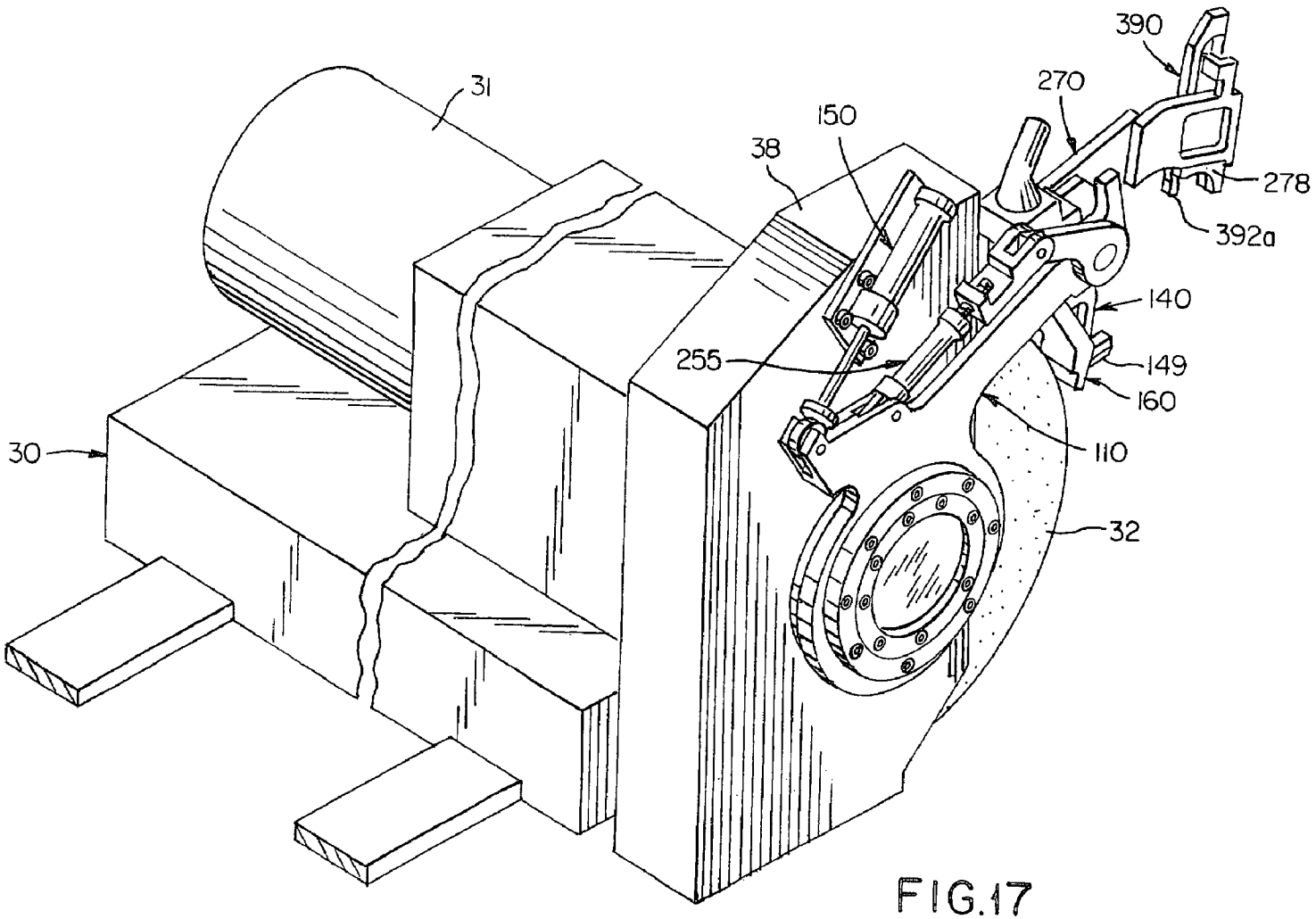

With reference to FIG. 17, an apparatus according to any of the foregoing embodiments may be mounted to the wheelhead 30 such that the grinding wheel 32 is positioned between the spindle housing 33 and the apparatus. Such an arrangement allows for easy mounting and unmounting of the apparatus from the wheelhead 30 without requiring unmounting of the grinding wheel 32 therefrom. It will be apparent to those of ordinary skill in the art that such an "outboard" arrangement requires that the various components (for example, the primary arm 110, a secondary arm 120, a first linear actuator 150, a coolant nozzle assembly 160, a support arm 270, a second linear actuator 255, a support shoe 278 and a gauge assembly 390) of the several embodiments must be oppositely-handed to the arrangements described above.

It will be apparent to those of ordinary skill in the art, upon reading the within description of the present invention, that the present invention may be implemented on machinery used to machine eccentric workpieces rotating on non-orbiting centers or to machine cylindrical surfaces rotating on non-orbiting centers, in addition to the orbiting surfaces described in the exemplary embodiments hereof.

The present invention provides an apparatus for mounting a device to a grinding machine such that the device operates for its intended purpose at substantially all times during the machining cycle.

The present invention furthermore provides an apparatus for mounting a device to a grinding machine such that the orientation and motion of the device mimics the orientation and motion of the workpiece during the machining cycle.

The present invention even further provides an apparatus for mounting a device to a grinding machine such that the orientation and motion of the device mimics the orientation and motion of the workpiece during the machining cycle, wherein the workpiece travels along an orbital or eccentric path during the machining cycle.

The present invention further yet provides an apparatus for mounting a device to a grinding machine adapted to machine selected portions of crankshafts and of other orbiting and eccentric workpieces.

The present invention still further yet provides an apparatus for delivering coolant to a machining zone of a grinding machine.

The present invention furthermore provides an apparatus for positioning a workpiece support device near a workpiece being machined.

The present invention even further provides an apparatus for positioning an in-process gauge device near a workpiece being machined.

The present invention still even further provides an apparatus for positioning various devices near a workpiece during machining operations such that the device maintains contact with the workpiece for substantially the entire machining operation.

The present invention also provides an apparatus for positioning various devices near a workpiece during machining operations, wherein the apparatus is adapted to manually or automatedly disengaged the workpiece when commanded.

The present invention even further provides an apparatus for positioning various devices near a workpiece during machining operations, wherein motion of the apparatus has a minimum number of degrees of freedom with reference to motion of the workpiece, and preferably, has only a single degree of freedom with reference to motion of the grinding machine or a portion thereof, such as the wheelhead.

While the invention has been described and illustrated with reference to one or more preferred embodiments thereof, and such preferred embodiments have been described in considerable detail with reference to the drawings, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

We claim:

1. An apparatus mounted to a machine having a spindle, for positioning a device near a workpiece during a machining operation, said workpiece being movable relative to a machining tool during said machining operation, wherein at least a portion of said workpiece moves along an arcuate path relative to said machining tool, said apparatus comprising:

an arm coupled to said spindle of said machine and movable relative thereto to mimic movement of said at least a portion of said workpiece relative to said machining tool, said arm having a portion adapted for contact with a machined portion of said workpiece during said machining operation, wherein said machining tool rotates about an axis, wherein said axis defines a center of said arcuate path and wherein said arm rotatably oscillates about said axis such that said arm rises and falls with the workpiece along the arcuate path during said machining operation.

2. The apparatus of claim 1, wherein said at least a portion of said workpiece travels along an orbiting path relative to said machine and wherein said machining tool translates relative to said workpiece in unison therewith.

3. The apparatus of claim 2, wherein said at least a portion of said workpiece includes an eccentric surface to be machined.

4. The apparatus of claim 2, wherein said at least a portion of said workpiece is a crankpin surface of a crankshaft.

5. The apparatus of claim 1, wherein said portion adapted for contact with said workpiece contacts said workpiece at substantially all times during said machining operation.

6. The apparatus of claim 1, wherein said arm further comprises: a primary arm having a rocker end and a distal end; and, a secondary arm coupled to said distal end of said primary arm, said secondary arm extending from said primary arm to form an angle therewith, said portion being adapted for contact with said machined portion of said workpiece is a shoe mounted to a lower end of said secondary arm.

7. The apparatus of claim 6, wherein said actuator engages an arm of said primary arm to move said primary arm in at least a first direction.

8. The apparatus of claim 7, wherein said actuator is disengaged from said arm when said primary arm is in an engaged position.

9. The apparatus of claim 1, further comprising an actuator coupled to said arm for moving said arm between a retracted position and an engaged position, wherein said actuator is a hydraulic cylinder having a first portion mounted to said machine and a second portion extendable relative thereto.

10. The apparatus of claim 1, wherein said device includes a coolant nozzle assembly.

11. The apparatus of claim 1, wherein said device includes a support shoe as said portion adapted for contact with said machined portion of said workpiece and wherein said apparatus further comprises: a support arm having an upper end pivotably mounted to said arm, said support shoe being mounted to a lower end of said support arm; and, a second actuator having a first portion connected to said arm and a second portion connected to said support arm for moving said support arm relative to said arm between a retracted position and an engaged position, wherein said support shoe contacts said workpiece when said support arm is in said engaged position.

12. The apparatus of claim 11, wherein said support shoe contacts said machined portion of said workpiece at substantially all times during said machining operation.

13. The apparatus of claim 11, wherein said second portion of said second actuator is connected to an upper end of said support arm by a clevis.

14. The apparatus of claim 11, wherein said support shoe is removable from said support arm.

15. The apparatus of claim 11, wherein said device includes a gauge assembly mounted to said lower end of said support arm, wherein said gauge assembly engages at least a portion of said workpiece when said arm is in said engaged position and when said support arm is in said engaged position, and wherein said gauge assembly is retracted substantially from said at least a portion of said workpiece when support arm is in said retracted position.

16. The apparatus of claim 15, wherein said gauge assembly is adapted to measure a diametral portion of said workpiece.

17. The apparatus of claim 15, wherein said gauge assembly is adapted to move relative to said support arm for the purpose of locating said at least a portion of said workpiece.

18. The apparatus of claim 17, wherein said gauge assembly is mounted to said lower end of said support arm by at least one leaf spring, each of said at least one leaf spring having a first end connected to said gauge assembly and a second end connected to said support arm.

19. The apparatus of claim 18, wherein said at least one leaf spring includes a first leaf spring and a second leaf spring and wherein said first and second leaf springs are mounted to said support arm to permit motion of said gauge assembly relative to said support arm in at least two directions of motion.

20. The apparatus of claim 11, wherein said device includes a coolant nozzle assembly.

21. The apparatus of claim 1, wherein said device includes a gauge assembly and wherein said apparatus further comprises: a support arm having a lower end, and an upper end pivotably mounted to said arm; and, a second actuator having a first portion connected to said arm and a second portion connected to said support arm for moving said support arm relative to said arm between a retracted position and an engaged position, wherein said gauge assembly is mounted to said lower end of said support arm so that said gauge assembly engages at least a portion of said workpiece when said support arm is in said engaged position, and wherein said gauge assembly is mounted to said lower end of said support arm so that said gauge assembly is retracted substantially from said at least a portion of said workpiece when support arm is in said retracted position.

22. The apparatus of claim 21, wherein said gauge assembly is adapted to measure a diametral portion of said workpiece.

23. The apparatus of claim 1, further comprising an actuator coupled to said arm for moving said arm between a retracted position and an engaged position.

24. The apparatus of claim 23, wherein said actuator is a linear actuator.

25. A machine having an apparatus for positioning a device near a workpiece during a machining operation, said workpiece being movable relative to a machining tool during said machining operation, wherein at least a portion of said workpiece travels along an arcuate path relative to said machining tool, said apparatus comprising:

an arm coupled to said machine and movable relative thereto to mimic movement of said at least a portion of said workpiece relative to said machining tool, said arm having a portion adapted for contact with said machined portion of said workpiece during said machining operation, wherein said machining tool rotates about an axis, wherein said axis defines a center of said arcuate path and wherein said arm rotatably oscillates about said axis such that said arm rises and falls with the workpiece along the arcuate path during said machining operation; and a device to cause rotation of said arm about said axis between a retracted position and an engaged position;

wherein said machine includes a spindle having a spindle housing, wherein said machining tool is mounted to a rotating portion of said spindle and wherein said apparatus is mounted to said spindle between said spindle housing and said machining tool.

26. The machine of claim 25, wherein said arm includes an opening therethrough sized to fit over at least a portion of said spindle and wherein said apparatus further comprises: an outer ring affixed to said arm; an inner ring affixed to said spindle; and, a bearing positioned between said outer ring and said inner ring for relative movement therebetween.

27. The machine of claim 26, wherein said bearing is selected from the group comprising ball bearings, roller bearings, sleeve bearings, fluid film bearings and bushings.

28. The machine of claim 25, wherein said device is a linear actuator coupled to said arm for moving said arm between a retracted position and an engaged position.

29. The machine of claim 25, wherein said apparatus further comprises a bearing assembly, said arm being mounted to the spindle by the bearing assembly, wherein said bearing assembly includes an inner ring configured for mounting to said spindle of said machine, an outer ring, and a bearing between said inner and outer rings, and also wherein said arm includes an end mounted to said outer ring, an extension extending from said end, and a workpiece contact portion carried by said extension.

30. The machine of claim 29, wherein said apparatus further comprises a device carried by said arm wherein the device includes at least one of a coolant nozzle, gage, or workpiece support, also wherein said arm includes a primary arm portion including the end mounted to the outer ring and including the extension, and further includes a secondary arm portion carried by the primary arm and including the workpiece contact portion and carrying the device.

31. A machine having an apparatus for positioning a device near a workpiece during a machining operation, said workpiece being movable relative to a machining tool during said machining operation, wherein at least a portion of said workpiece travels along an arcuate path relative to said machining tool, said apparatus comprising:

an arm coupled to said machine and movable relative thereto to mimic movement of said at least a portion of said workpiece relative to said machining tool, said arm having a portion adapted for contact with said machined portion of said workpiece during said machining operation, wherein said machining tool rotates about an axis, wherein said axis defines a center of said arcuate path and wherein said arm rotatably oscillates about said axis such that said arm rises and falls with the workpiece along the arcuate path during said machining operation; and a device to cause rotation of said arm about said axis between a retracted position and an engaged position;

wherein said machine includes a spindle having a spindle housing, wherein said apparatus is mounted to said spindle and wherein said machining tool is mounted to said spindle between said spindle housing and said apparatus.

32. The machine of claim 31, wherein said device is a linear actuator coupled to said arm for moving said arm between a retracted position and an engaged position.

33. An apparatus mounted to a machine having a spindle, for positioning a device near a workpiece wherein at least a portion of the workpiece is movable along an arcuate path relative to a machining tool wherein the machining tool rotates about an axis that defines a center of said arcuate path, said apparatus comprising an arm coupled to said spindle and rotatable about said axis wherein said arm rotatably oscillates about said axis such that said arm rises and falls with the workpiece along the arcuate path during said machining operation and having a portion for contacting a machined portion of the workpiece to mimic movement of the workpiece.

34. The apparatus of claim 33, further comprising an actuator coupled to said arm for rotating said arm about said axis between a retracted position with respect to the workpiece and an engaged position with the workpiece.

35. The apparatus of claim 33 wherein said arm includes an opening therethrough to fit said arm over at least a portion of said machine and wherein said apparatus further comprises an outer ring affixed to said arm, an inner ring affixed to said machine, and a bearing positioned between said outer ring and said inner ring for relative movement therebetween.

36. The apparatus of claim 33 wherein said arm is mounted to said machine at least one of inboard of said machining tool or outboard of said machining tool.

37. The apparatus of claim 33 further comprising said device mounted to said arm.

38. The apparatus of claim 37 wherein said device includes at least one of a support arm to support the workpiece from flexure due to loading by said machining tool, a coolant nozzle for cooling the workpiece, or a gauge for measuring the workpiece.

* * * * *